US007533528B2

(12) United States Patent
Fox

(10) Patent No.: US 7,533,528 B2
(45) Date of Patent: May 19, 2009

(54) ACTUATOR ASSEMBLY

(75) Inventor: Nigel Peter Fox, Rugeley (GB)

(73) Assignee: Norgren Limited, Staffordshire (GB)

( * ) Notice: Subject to any disclaimer, the term of this patent is extended or adjusted under 35 U.S.C. 154(b) by 220 days.

(21) Appl. No.: 11/569,993

(22) PCT Filed: Jun. 8, 2005

(86) PCT No.: PCT/GB2005/002279

§ 371 (c)(1),
(2), (4) Date: Dec. 4, 2006

(87) PCT Pub. No.: WO2005/121563

PCT Pub. Date: Dec. 22, 2005

(65) Prior Publication Data

US 2008/0006030 A1 Jan. 10, 2008

(30) Foreign Application Priority Data

Jun. 9, 2004 (GB) ..... 0412810.4

(51) Int. Cl.
*F15B 7/00* (2006.01)
*F15B 15/22* (2006.01)

(52) U.S. Cl. ..... 60/565; 60/593

(58) Field of Classification Search ..... 60/547.1, 60/565, 567, 593
See application file for complete search history.

(56) References Cited

U.S. PATENT DOCUMENTS

| | | | | |
|---|---|---|---|---|
| 3,693,702 | A | 9/1972 | Piekenbrink et al. | |
| 5,247,871 | A * | 9/1993 | Brasca et al. | 60/593 |
| 5,337,565 | A | 8/1994 | Meixner et al. | |

FOREIGN PATENT DOCUMENTS

| | | | |
|---|---|---|---|
| CN | 1418291 | A | 5/2003 |
| DE | 3228109 | | 2/1984 |
| DE | 3915175 | A1 | 11/1989 |
| DE | 3916539 | A1 | 11/1990 |
| GB | 2049824 | A | 12/1980 |
| JP | 2002086319 | A | 3/2002 |
| JP | 2002089503 | A | 3/2002 |

* cited by examiner

*Primary Examiner*—Thomas E Lazo
(74) *Attorney, Agent, or Firm*—The Ollila Law Group LLC

(57) ABSTRACT

An actuator assembly (1) comprises a body (2) in which works an actuating piston (7), a first piston (5) and at least one second piston (6), a chamber (26) containing a substantially incompressible fluid by which each of the first and second pistons (5, 6) acts on the actuating piston (7). The movement of the first piston (5) from a retracted position to an extended position acts via the fluid to cause the actuating piston (7) to move from a retracted position to an operational position, and subsequent movement of a second piston (6) from a retracted position to an extended position acts via the fluid to cause an actuation movement of the actuating piston (7).

11 Claims, 2 Drawing Sheets

ACTUATOR ASSEMBLY

FIELD OF INVENTION

This invention relates to an actuator assembly.

BACKGROUND OF INVENTION

Actuators are used to activate or position devices for performing their operations. Thus, many different types of actuator are required to fulfil the wide range of applications in which they are used. In some applications, control of the force applied to the device by the actuator is important, while in others control of the distance moved by the device and the rapidity of actuation is more important. For example, in thermal printing applications, in particular high volume thermal printing, the thermal print head must be able to be actuated rapidly and accurately. Further, the actuator must also be robust to withstand operational forces without loss of accuracy.

SUMMARY OF INVENTION

According to the invention we provide an actuator assembly comprising a body in which works an actuating piston, a first piston and at least one second piston, a chamber containing a substantially incompressible fluid by which each of the first and second pistons acts on the actuating piston, the arrangement being such that movement of the first piston from a retracted position to an extended position acts via the fluid to cause the actuating piston to move from a retracted position to an operational position, and subsequent movement of a second piston from a retracted position to an extended position acts via the fluid to cause an actuation movement of the actuating piston.

This arrangement enables the actuating piston initially to move accurately from a retracted position to an operational position using the first piston, and then to be actuated accurately and rapidly by the second piston. The distances moved by the actuating piston are controlled by the use of the incompressible fluid as the displacement medium.

Preferably the incompressible fluid is n hydraulic fluid. The chamber is conveniently sealed, to contain a fixed volume.

The first and second pistons may be operated in any suitable way. Preferably pneumatic pressure is used to extend the pistons, and the return movement is provided by a spring. The actuating piston is returned to its operational and retracted position in any suitable way, such as by vacuum or a return spring.

It will be appreciated that the first piston must remain in its extended position in order for the second piston to move the actuating piston in its actuation movement. The pneumatic pressure will therefore be maintained for the first piston, to ensure that it remains extended, while the pneumatic pressure is supplied intermittently to the second piston to cause oscillation of the actuating piston.

The first and second pistons may be at opposite ends of a bore in the body. The chamber is then defined between them. The actuating piston works in a bore which extends orthogonally from the chamber. The stroke of each of the first and second pistons is limited by shoulders in the bore.

More than one second piston may be provided, with each acting to move the actuating piston by a different amount. The appropriate second piston can then be used for any given application.

There now follows by way of example only a detailed description of the present invention with reference to the accompanying drawings in which:

DETAILED DESCRIPTION OF THE INVENTION

Figure 1:
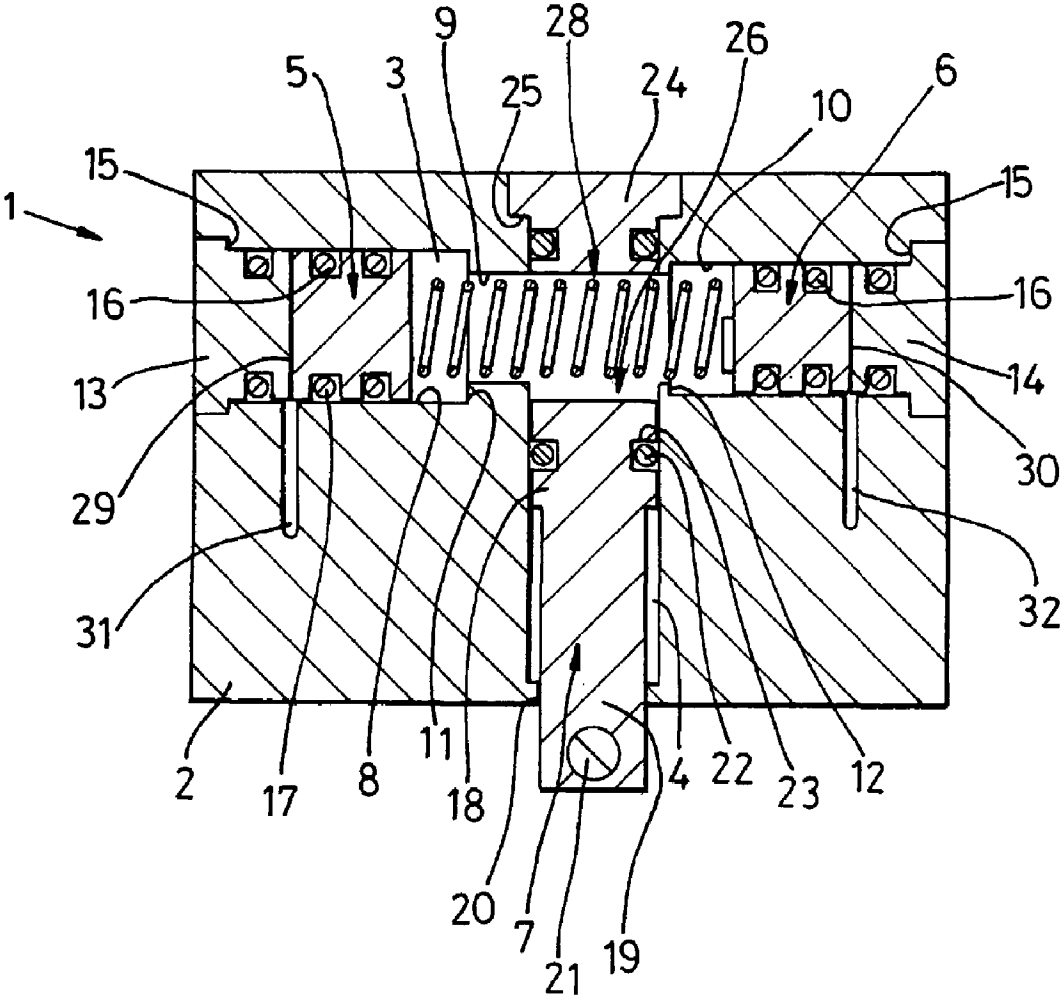
FIG. 1 shows a cross-section through an actuator assembly according to the invention in a retracted position.

FIG. 1 shows an actuator assembly 1 in the form of a print head actuator for a thermal printer. The assembly 1 comprises a body 2 having a first stepped bore 3 and a second bore 4. A first piston 5 is slidably mounted at one end of bore 3 and one second piston 6 is slidably mounted at the other end. An actuating piston 7 is mounted in the second bore 4.

The stepped bore 3 comprises a first section 8, a narrower central section 9 and second section 10, separated by shoulders 11, 12. The shoulder 11 separates the first and central sections 8, 9 and shoulder 12 separates the central section 9 from the second section 10.

The first section 8 contains the first piston 5, which is able to slide therein between an end plug 13 and the shoulder 11. Similarly, the second piston 6 is mounted in the second section 10 of bore 3 and can slide between an end plug 14 and the shoulder 12. The end plugs 13, 14 are mounted in recesses 15 such that they are flush with the surface of the body 2. The pistons 5, 6 both have circumferential grooves 16 for receiving O-ring seals 17 to seal between the pistons 5, 6 and the bore 3.

Figure 3:
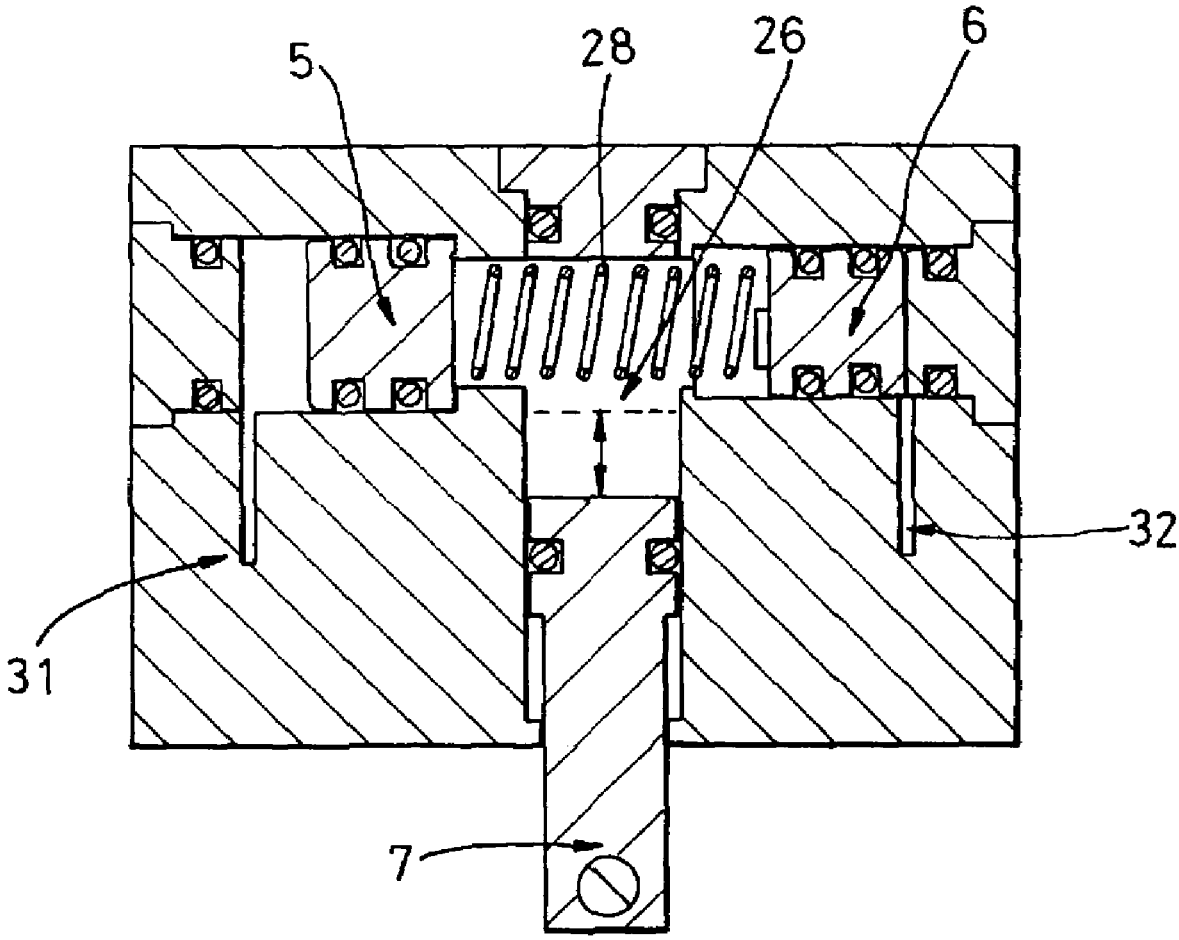
FIG. 3 shows a cross-section through an actuator assembly according to the invention in an operational position.

The second bore 4 intersects the first bore 3 and passes orthogonally through the central section 9. The actuating piston 7 is mounted in the bore 4 such that it can move between a retracted position (as shown in FIG. 1) and an operational position (as shown in FIG. 3). The actuating piston 7 comprises a piston portion 18 and a piston rod 19 that extends out of the bore 4 through an aperture 20. The piston rod 19 includes a mounting portion 21 for mounting a device, such as a thermal print head, to the distal end thereof. An O-ring seal 22 is mounted within a circumferential groove 23 in the piston portion 18 to seal between the actuating piston 7 and the bore 4. The second bore 4 also has an end plug 24 in its end opposite the aperture 20. The plug 24 is sealingly received in a recess 25 such that it is flush with the body 2.

The central section 9 defines part of a chamber 26 in bores 3 and 4 delimited by the first, second and actuating pistons 5, 6, 7. The chamber 26 contains a fixed volume of substantially incompressible fluid, such as hydraulic fluid, which enables, in use, movement of the first and second pistons 5, 6 to control movement of the actuating piston 7.

Figure 2:
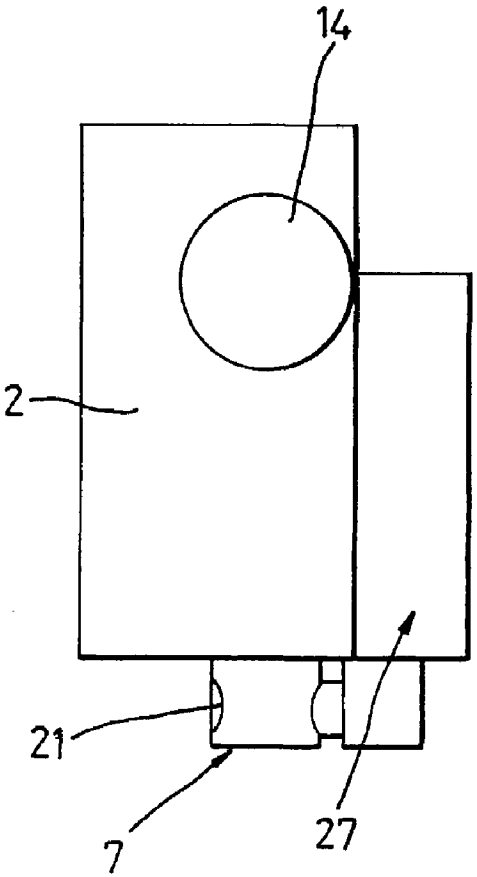
FIG. 2 shows a side view of the actuator assembly shown in FIG. 1.

The actuator assembly, as shown in FIG. 2, includes a low friction linear slide assembly 27 to absorb lateral forces on the assembly. The assembly 27 comprises a crossed roller linear slide, but may be a linear ball bearing slide or any other suitable load bearing assembly. The crossed roller linear slide 27 is mounted to the body 2 and is connected to part of the mounting portion 21 of actuating piston 7.

A return spring 28 is mounted in the bore 3 and abuts the first and second pistons 5, 6. The pistons 5, 6 are caused to move by the supply of a pneumatic signal that acts upon their rear faces 29 and 30 respectively. The pneumatic signals are supplied through narrow pneumatic bores from a supply (not shown) wherein a first pneumatic bore 31 controls the first piston 5 and a second pneumatic bore 32 controls the second piston 6.

In use, the actuator assembly 1 may comprise an actuator for a thermal print head (not shown), which is mounted to the mounting portion 21. The assembly 1 may be located adjacent a conveyor belt that carries items which are to be printed. A pneumatic signal is applied and maintained through the first pneumatic bore 31 to move the first piston 5 from its rest position (as shown in FIG. 1) to a position in which it abuts shoulder 11 (as shown in FIG. 3). The movement of piston 5 causes, via the hydraulic fluid in chamber 26, the actuating piston 7 to move approximately 10 mm from its retracted position (as shown in FIG. 1) to its operational position (as shown in FIG. 3). In the operational position the print head is within printing distance of the items on the conveyor. A pneumatic signal can then be applied through pneumatic bore 32 to move the second piston 6 against the force of the return spring 28. Movement of piston 6, while piston 5 is actuated, actuates the actuating piston 7 and print head by moving them approximately 6 mm further out of aperture 20, into printing contact with the items on the conveyor system. Upon loss of the pneumatic signal at pneumatic bore 32, the piston 6 is urged, by the return spring 28, to its rest position as shown in FIG. 1. This causes the actuating piston 7 and the print head to withdraw to the operational position by the vacuum created in the chamber 26. Thus, when the conveyor system is conveying items to be printed past the print head, the actuating piston 7 can be oscillated by the application of a timed pneumatic signal at bore 32, such that the print head prints on to successive items. The assembly 1 of the invention can cyclically actuate the print head at speeds of typically 700 cycles/minute. Thus, many items can be accurately and rapidly printed as they pass the print head along the conveyor system. Once the printing has been completed, both pneumatic signals to bores 31, 32, are turned off, enabling the return spring 28 to return the pistons 5, 6 to the positions shown in FIG. 1 thereby withdrawing actuating piston 7 to its retracted position. The actuating piston 7 is withdrawn by the vacuum effect of the hydraulic fluid but it will be appreciated that a coil spring (not shown) may be utilized to return piston 7 to its retracted position.

As the print head oscillates and strikes each item on the conveyor, although the contact time is short, the actuator assembly 1 will experience a lateral force that can cause the components of the assembly 1 to wear. This lateral force is absorbed by the crossed roller linear slide 27 thereby extending the life of the actuating piston 7 and other components of the assembly.

It will be appreciated that several second pistons 6 may be provided in bores that connect with chamber 26, the pistons or bores being of various sizes or lengths to displace different amounts of hydraulic fluid upon the application of a pneumatic signal. Thus, the actuating piston 7 could be caused to oscillate at different displacements depending on which second piston 6 is actuated to suit the application the assembly 1 is used for.

The invention claimed is:

1. An actuator assembly comprising a body (2) in which works an actuating piston (7), a first piston (5) and at least one second piston (6), a chamber (26) containing a substantially incompressible fluid by which each of the first and second pistons (5, 6) acts on the actuating piston (7), the arrangement being such that movement of the first piston (5) from a retracted position to a fully extended position acts via the fluid to cause the actuating piston (7) to move from a retracted position to an operational position, and with the first piston 5 remaining in its fully extended position, subsequent movement of a second piston (6) from a retracted position to an extended position acts via the fluid to cause an actuation movement of the actuating piston (7), and in which pneumatic pressure is used to extend the pistons (5, 6).

2. The actuator assembly according to claim 1, in which the incompressible fluid is a hydraulic fluid.

3. The actuator assembly according to claim 1 or claim 2, in which the chamber (26) is sealed, to contain a fixed volume.

4. The actuator assembly according to claim 1, in which the return movement of the pistons (5, 6) is provided by a spring (28).

5. The actuator assembly according to claim 1, in which the actuating piston (7) is returned to its retracted position by application of a vacuum.

6. The actuator assembly according to claim 1, in which the actuating piston (7) is returned to its retracted position by a return spring.

7. The actuator assembly according to claim 1, in which the first and second pistons (5, 6) arc at opposite ends of a bore (3) in the body (2).

8. The actuator assembly according to claim 7, in which the stroke of each of the first and second pistons (5, 6) is limited by shoulders (11, 12) in the bore (3).

9. The actuator assembly according to claim 1, in which the chamber (26) is defined by the first and second pistons (5, 6) and actuating piston (7).

10. The actuator assembly according claim 1, in which the actuating piston (7) works in a bore (4) which extends orthogonally from the chamber (26).

11. The actuator assembly according to claim 1, in which more than one second piston (6) is provided, each acting to move the actuating piston (7) by a different amount.

* * * * *